US011802724B2

(12) United States Patent
Washiyama et al.

(10) Patent No.: US 11,802,724 B2
(45) Date of Patent: Oct. 31, 2023

(54) AIR-CONDITIONING APPARATUS WITH SIMULTANEOUS HEATING AND DEFROSTING MODES

(71) Applicant: Mitsubishi Electric Corporation, Tokyo (JP)

(72) Inventors: Hiroki Washiyama, Tokyo (JP); Yuji Motomura, Tokyo (JP); Kimitaka Kadowaki, Tokyo (JP); Koji Azuma, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 401 days.

(21) Appl. No.: 17/263,259

(22) PCT Filed: Sep. 28, 2018

(86) PCT No.: PCT/JP2018/036575

§ 371 (c)(1),
(2) Date: Jan. 26, 2021

(87) PCT Pub. No.: WO2020/066015

PCT Pub. Date: Apr. 2, 2020

(65) Prior Publication Data

US 2021/0190402 A1 Jun. 24, 2021

(51) Int. Cl.
*F25B 47/02* (2006.01)
*F25B 13/00* (2006.01)

(52) U.S. Cl.
CPC ..... *F25B 47/025* (2013.01); *F25B 13/00* (2013.01); *F25B 2313/02332* (2013.01); *F25B 2313/02532* (2013.01); *F25B 2600/025* (2013.01); *F25B 2700/2103* (2013.01); *F25B 2700/2104* (2013.01)

(58) Field of Classification Search
CPC ..... F25B 13/00; F25B 49/02; F25B 2313/02332; F25B 2313/02532;
(Continued)

(56) References Cited

U.S. PATENT DOCUMENTS

2004/0107710 A1* 6/2004 Lee ..... F25B 13/00 236/44 R
2015/0034293 A1* 2/2015 Takayama ..... F24F 11/54 165/207
(Continued)

FOREIGN PATENT DOCUMENTS

GB 2548522 A 9/2017
JP H05-071833 A 3/1993
(Continued)

OTHER PUBLICATIONS

Office Action dated Dec. 17, 2021 issued in corresponding CN patent application No. 201880097883.9 (and English translation).
(Continued)

*Primary Examiner* — Henry T Crenshaw
(74) *Attorney, Agent, or Firm* — POSZ LAW GROUP, PLC

(57) ABSTRACT

An air-conditioning apparatus includes outdoor units each including a compressor and outdoor heat exchanger, refrigerant flowing through the outdoor units; an indoor unit including an indoor heat exchanger, a heat medium flowing through the indoor unit; relay devices to which the outdoor units are connected, and to which the indoor unit is connected, each relay device includes a heat medium heat exchanger that exchanges heat between the refrigerant and the heat medium; and a controller. The controller controls action of the outdoor units, the indoor unit, and the relay devices. The controller determines necessity for a defrosting operation; responsive the defrosting operation being necessary, compares an indoor unit total load with an outdoor unit
(Continued)

total capacity; and controls an operating frequency of the compressor of an outdoor unit other than the outdoor unit on which the defrosting operation is to be performed to increase the outdoor unit total capacity.

11 Claims, 5 Drawing Sheets

(58) Field of Classification Search
CPC ..... F25B 25/005; F25B 2600/025; F25B 2339/047; F25B 2313/0314; F25B 2400/13; F25B 2600/01; F25B 2600/2501; F25B 2700/2103; F25B 2700/2104; F25B 31/006; F25B 47/022; F25B 47/025
See application file for complete search history.

(56) References Cited

U.S. PATENT DOCUMENTS

| | | | | |
|---|---|---|---|---|
| 2015/0059380 | A1 | 3/2015 | Takayama et al. | |
| 2015/0292777 | A1* | 10/2015 | Okano | F24F 11/77 62/129 |
| 2017/0089616 | A1 | 3/2017 | Yamashita | |
| 2019/0078497 | A1* | 3/2019 | Enomoto | B60K 11/04 |

FOREIGN PATENT DOCUMENTS

| | | | |
|---|---|---|---|
| JP | H0571833 | * | 3/1993 |
| JP | H08-303903 | A | 11/1996 |
| JP | 2000-002474 | A | 1/2000 |
| JP | 2005-090784 | A | 4/2005 |
| JP | 2010-071544 | A | 4/2010 |
| WO | 2013/144996 | A1 | 10/2013 |
| WO | 2015/140885 | A1 | 9/2015 |
| WO | 2016/113830 | A1 | 7/2016 |

OTHER PUBLICATIONS

Office Action dated Oct. 12, 2021, issued in corresponding JP Patent Application No. 2020-547879 (and English Machine Translation).
Extended European Search Report dated Aug. 12, 2021 issued in corresponding European patent application No. 18935245.3.
International Search Report of the International Searching Authority dated Dec. 25, 2018 for the corresponding international application No. PCT/JP2018/036575 (and English translation).

* cited by examiner

AIR-CONDITIONING APPARATUS WITH SIMULTANEOUS HEATING AND DEFROSTING MODES

CROSS REFERENCE TO RELATED APPLICATION

This application is a U.S. national stage application of PCT/JP2018/036575 filed on Sep. 28, 2018, the contents of which are incorporated herein by reference.

TECHNICAL FIELD

The present disclosure relates to an air-conditioning apparatus that exchanges heat between refrigerant circulating through a refrigerant circulation circuit and a heat medium circulating through a heat medium circulation circuit.

BACKGROUND ART

Conventionally, direct expansion air-conditioning apparatuses have been used where an outdoor unit and indoor units are connected with each other, and refrigerant is caused to circulate between the outdoor unit and the indoor units to air-condition an indoor space being a space to be air-conditioned (see Patent Literature 1, for example). There are also some air-conditioning apparatuses that include a plurality of outdoor units and a plurality of indoor units, the plurality of indoor units being connected in parallel to the plurality of outdoor units connected in series to perform air conditioning of a plurality of indoor spaces.

In such an air-conditioning apparatus, a defrosting operation is performed to remove frost when the frost forms on an outdoor heat exchanger provided to any of the plurality of outdoor units during the heating operation where a heat exchanger provided to the outdoor unit serves as an evaporator. During the defrosting operation, the outdoor heat exchanger serves as a condenser, and refrigerant with a high temperature is supplied to the outdoor heat exchanger, so that frost on the outdoor heat exchanger is removed by heat of the refrigerant.

CITATION LIST

Patent Literature

Patent Literature 1: International Publication No. WO 2015/140885

SUMMARY OF INVENTION

Technical Problem

In the air-conditioning apparatus where the plurality of outdoor units are connected in series, the defrosting operation for even a single outdoor unit requires the defrosting operations performed on the other outdoor units in the same manner. Therefore, during the defrosting operation, the operation of all indoor units is stopped, so that the temperature of the indoor space decreases.

The present disclosure has been made in view of the above-mentioned problem in the conventional technique, and it is an object of the present disclosure to provide an air-conditioning apparatus that can continue a heating operation without stopping the operation of the indoor unit even during the defrosting operation.

Solution to Problem

An air-conditioning apparatus of an embodiment of the present disclosure includes: a plurality of outdoor units each including a compressor and an outdoor heat exchanger, refrigerant flowing through the plurality of outdoor units; an indoor unit including an indoor heat exchanger, a heat medium flowing through the indoor unit; a plurality of relay devices to which the plurality of outdoor units are connected independently, and to which the indoor unit is connected, each of the plurality of relay devices including a heat medium heat exchanger configured to exchange heat between the refrigerant and the heat medium; and a controller configured to control action of the plurality of outdoor units, the indoor unit, and the plurality of relay devices, wherein the controller includes a defrost determination unit configured to determine necessity for a defrosting operation for each of the plurality of outdoor units, a load determination unit configured to compare an indoor unit total load with an outdoor unit total capacity, in a case where the defrosting operation is necessary, the indoor unit total load indicating an air conditioning load during a heating operation, the outdoor unit total capacity indicating a capacity of an other outdoor unit excluding a target outdoor unit where the defrosting operation is necessary, and an equipment control unit configured to control an operating frequency of the compressor of the other outdoor unit to increase the outdoor unit total capacity in a case where the indoor unit total load is greater than the outdoor unit total capacity as a result of a comparison made by the load determination unit.

Advantageous Effects of Invention

According to the embodiment of the present disclosure, in the case where the indoor unit total load during the heating operation is greater than the outdoor unit total capacity, the outdoor unit total capacity of the outdoor units excluding the outdoor unit that is the target of the defrosting operation is increased to compensate for the outdoor unit total capacity reduced due to the defrosting operation. With such a compensation, the outdoor unit total capacity required during the heating operation can be ensured and hence, it is possible to continue the heating operation without stopping the operation of the indoor unit even during the defrosting operation.

DESCRIPTION OF EMBODIMENTS

Embodiment 1

Figure 1:
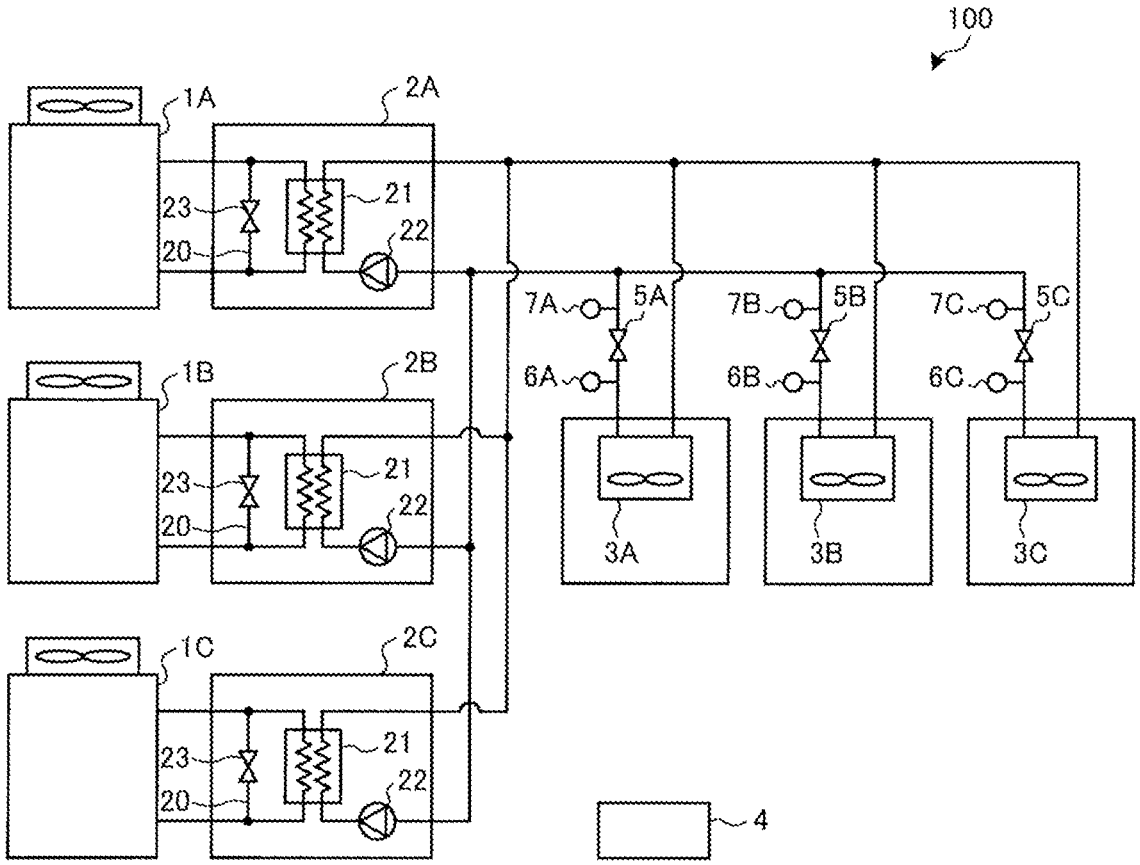
FIG. 1 is a schematic view showing an example of the configuration of an air-conditioning apparatus according to Embodiment 1.

Hereinafter, an air-conditioning apparatus according to Embodiment 1 of the present disclosure will be described. FIG. 1 is a schematic view showing an example of the configuration of an air-conditioning apparatus 100 according to Embodiment 1. As shown in FIG. 1, the air-conditioning apparatus 100 includes outdoor units 1A to 1C, relay devices 2A to 2C, indoor units 3A to 3C, and a controller 4.

[Configuration of Air-Conditioning Apparatus 100]

The relay devices 2A to 2C are independently provided, and the outdoor units 1A to 1C are connected to the relay devices 2A to 2C. Specifically, the outdoor unit 1A and the relay device 2A are connected by a refrigerant pipe, thus forming a refrigerant circulation circuit through which refrigerant circulates. The outdoor unit 1B and the relay device 2B are connected by a refrigerant pipe, thus forming a refrigerant circulation circuit through which refrigerant circulates. The outdoor unit 1C and the relay device 2C are connected by a refrigerant pipe, thus forming a refrigerant circulation circuit through which refrigerant circulates. In this example, the outdoor unit and the relay device are connected with each other on a one to one basis. However, the configuration is not limited to the above. For example, provided that a plurality of relay devices are provided independently, a plurality of outdoor units may be connected to one relay device.

The relay devices 2A to 2C and the indoor units 3A to 3C are connected by heat medium pipes, thus forming a heat medium circulation circuit through which a heat medium circulates. As the heat medium, for example, water, brine (antifreeze), mixed liquid of water and brine, or the like may be used. Hereinafter, the description will be made with reference to the example of the case where water is used as the heat medium. The indoor units 3A to 3C are connected in parallel to the relay devices 2A to 2C. In this example, three outdoor units 1A to 1C, three relay devices 2A to 2C, and three indoor units 3A to 3C are connected with each other. However, the number of outdoor units, the number of relay devices, and the number of indoor units are not limited to the numbers in this example. For example, one, two, or four or more indoor units may be used. Further, provided that a plurality of outdoor units and a plurality of relay devices are used, the number of outdoor units and the number of relay devices are not particularly limited.

The heat medium pipes connected to the indoor units 3A to 3C are provided with flow control valves 5A to 5C, pressure sensors 6A to 6C, and pressure sensors 7A to 7C. The flow control valves 5A to 5C control flow rates of water flowing through the indoor units 3A to 3C. The opening degrees of the flow control valves 5A to 5C are controlled by the controller 4. The pressure sensors 6A to 6C are provided at positions close to the water inflow sides of the flow control valves 5A to 5C, and detect pressures of water flowing into the flow control valves 5A to 5C. The pressure sensors 7A to 7C are provided at positions close to the water outflow side of the flow control valves 5A to 5C, and detect pressures of water flowing out from the flow control valves 5A to 5C.

(Outdoor Units 1A to 1C)

Figure 2:
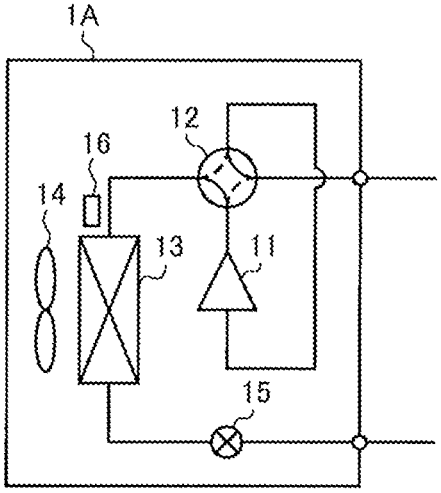
FIG. 2 is a schematic view showing an example of the configuration of an outdoor unit shown in FIG. 1.

FIG. 2 is a schematic view showing an example of the configuration of the outdoor unit 1A shown in FIG. 1. The outdoor units 1A to 1C have substantially the same configuration and hence, the description will be made by taking the outdoor unit 1A as an example hereinafter. As shown in FIG. 2, the outdoor unit 1A includes a compressor 11, a refrigerant flow passage switching device 12, an outdoor heat exchanger 13, and an outdoor fan 14.

The compressor 11 suctions refrigerant with low temperature and low pressure, compresses the suctioned refrigerant, and then discharges the refrigerant with high temperature and high pressure. The compressor 11 may be, for example, an inverter compressor or other compressor where a capacity, which is a feeding amount per unit time, can be controlled by changing the operating frequency of the compressor 11. The operating frequency of the compressor 11 is controlled by the controller 4 described later.

The refrigerant flow passage switching device 12 may be a four-way valve, for example. The refrigerant flow passage switching device 12 switches between a cooling operation and a heating operation by switching the flow direction of the refrigerant. At the time of performing the cooling operation, the refrigerant flow passage switching device 12 is switched such that, as shown by a solid line in FIG. 2, the discharge side of the compressor 11 and the outdoor heat exchanger 13 are connected with each other. At the time of performing the heating operation, the refrigerant flow passage switching device 12 is switched such that, as shown by a broken line in FIG. 2, the discharge side of the compressor 11 and the relay device are connected with each other. Switching of the flow passages in the refrigerant flow passage switching device 12 is controlled by the controller 4.

The outdoor heat exchanger 13 exchanges heat between refrigerant and outdoor air supplied by the outdoor fan 14. During the cooling operation, the outdoor heat exchanger 13 serves as a condenser that transfers heat of refrigerant to outdoor air to condense the refrigerant. During the heating operation, the outdoor heat exchanger 13 serves as an evaporator that evaporates refrigerant to cool outdoor air by heat of vaporization generated when the refrigerant is evaporated.

The outdoor fan 14 supplies air to the outdoor heat exchanger 13. The rotation speed of the outdoor fan 14 is controlled by the controller 4. The amount of air sent to the outdoor heat exchanger 13 is adjusted by controlling the rotation speed of the outdoor fan 14. An expansion device 15 may be an expansion valve, for example. The expansion device 15 causes refrigerant to expand. The expansion device 15 is a valve whose opening degree can be controlled, such as an electronic expansion valve, for example. The opening degree of the expansion device 15 is controlled by the controller 4.

The outdoor unit 1A also includes an outdoor-side outlet temperature sensor 16. The outdoor-side outlet temperature sensor 16 is provided at a position close to the refrigerant outflow side of the outdoor heat exchanger 13 during the heating operation, and detects a refrigerant outlet temperature that is the temperature of refrigerant flowing out from the outdoor heat exchanger 13 during the heating operation.

(Relay Devices 2A to 2C)

Each of the relay devices 2A to 2C in FIG. 1 includes a heat medium heat exchanger 21, a pump 22, and a bypass valve 23.

The heat medium heat exchanger 21 serves as a condenser or an evaporator, so exchanges heat between refrigerant flowing through the refrigerant circulation circuit connected to a refrigerant-side flow passage and a heat medium flowing through the heat medium circulation circuit connected to a heat-medium-side flow passage. During the cooling operation, the heat medium heat exchanger 21 serves as an evaporator that evaporates refrigerant to cool the heat medium by heat of vaporization generated when the refrigerant is evaporated. During the heating operation, the heat medium heat exchanger 21 serves as a condenser that transfers heat of refrigerant to the heat medium to condense the refrigerant.

The pump 22 is driven by a motor not shown in the drawing to circulate water flowing through the heat medium pipe and serving as a heat medium. The pump 22 may be a pump whose capacity can be controlled, for example. The flow rate of each pump 22 can be controlled depending on the magnitude of the load on the indoor unit 3A to 3C. The driving of the pump 22 is controlled by the controller 4. Specifically, the pump 22 is controlled by the controller 4 such that the pump 22 has a higher flow rate of water when the indoor unit has a larger load, and the pump 22 has a lower flow rate of water when the indoor unit has a smaller load.

The bypass valve 23 is provided to a bypass 20 that bypasses the outlet and the inlet of the refrigerant-side flow passage of the heat medium heat exchanger 21. When the bypass valve 23 is brought into an open state, refrigerant flowing through the refrigerant circulation circuit does not flow through the heat medium heat exchanger 21, but flows through the bypass 20 provided with the bypass valve 23. The opening and closing of the bypass valve 23 is controlled by the controller 4.

(Indoor Units 3A to 3C)

Figure 3:
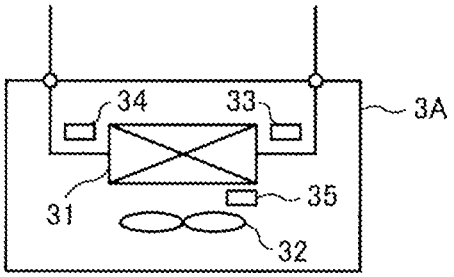
FIG. 3 is a schematic view showing an example of the configuration of an indoor unit shown in FIG. 1.

FIG. 3 is a schematic view showing an example of the configuration of the indoor unit 3A shown in FIG. 1. The indoor units 3A to 3C have substantially the same configuration and hence, the description will be made by taking the indoor unit 3A as an example hereinafter. As shown in FIG. 3, the indoor unit 3A includes an indoor heat exchanger 31 and an indoor fan 32.

The indoor heat exchanger 31 exchanges heat between water (including hot water) and indoor air supplied by the indoor fan 32. Such heat exchange generates air for cooling or air for heating being conditioned air to be supplied to the indoor space. The indoor fan 32 supplies air to the indoor heat exchanger 31. The rotation speed of the indoor fan 32 is controlled by the controller 4. The amount of air sent to the indoor heat exchanger 31 is adjusted by controlling the rotation speed of the indoor fan 32.

The indoor unit 3A also includes an indoor-side inlet temperature sensor 33, an indoor-side outlet temperature sensor 34, and a suction temperature sensor 35. The indoor-side inlet temperature sensor 33 is provided at a position close to the water inflow side of the indoor unit 3A, and detects a heat medium inlet temperature being the temperature of water flowing into the indoor unit 3A. The indoor-side outlet temperature sensor 34 is provided at a position close to the water outflow side of the indoor unit 3A, and detects the heat medium outlet temperature being the temperature of water flowing out from the indoor unit 3A. The suction temperature sensor 35 is provided at a position close to the air suction side of the indoor unit 3A, and detects the suction air temperature of air suctioned into the indoor unit 3A.

(Controller 4)

The controller 4 controls the action of the entire air-conditioning apparatus 100 that includes the outdoor units 1A to 1C, the relay devices 2A to 2C, and the indoor units 3A to 3C based on various information received from the various sensors provided to the units of the air-conditioning apparatus 100. Particularly, in Embodiment 1, the controller 4 controls the operating frequency of the compressor 11, the driving of the pump 22, the opening and closing of the bypass valve 23, the driving of the indoor fan 32 and the like based on the magnitudes of the loads on the indoor units 3A to 3C.

The various functions of the controller 4 are implemented by executing software in an arithmetic unit, such as a microcomputer. Alternatively, the controller 4 is hardware or the like, such as a circuit device, that implements various functions. In Embodiment 1, the controller 4 is provided separately from each equipment. However, the configuration is not limited to the above. For example, the controller 4 may be provided to any of the outdoor units 1A to 1C, the relay devices 2A to 2C, and the indoor units 3A to 3C.

Figure 4:
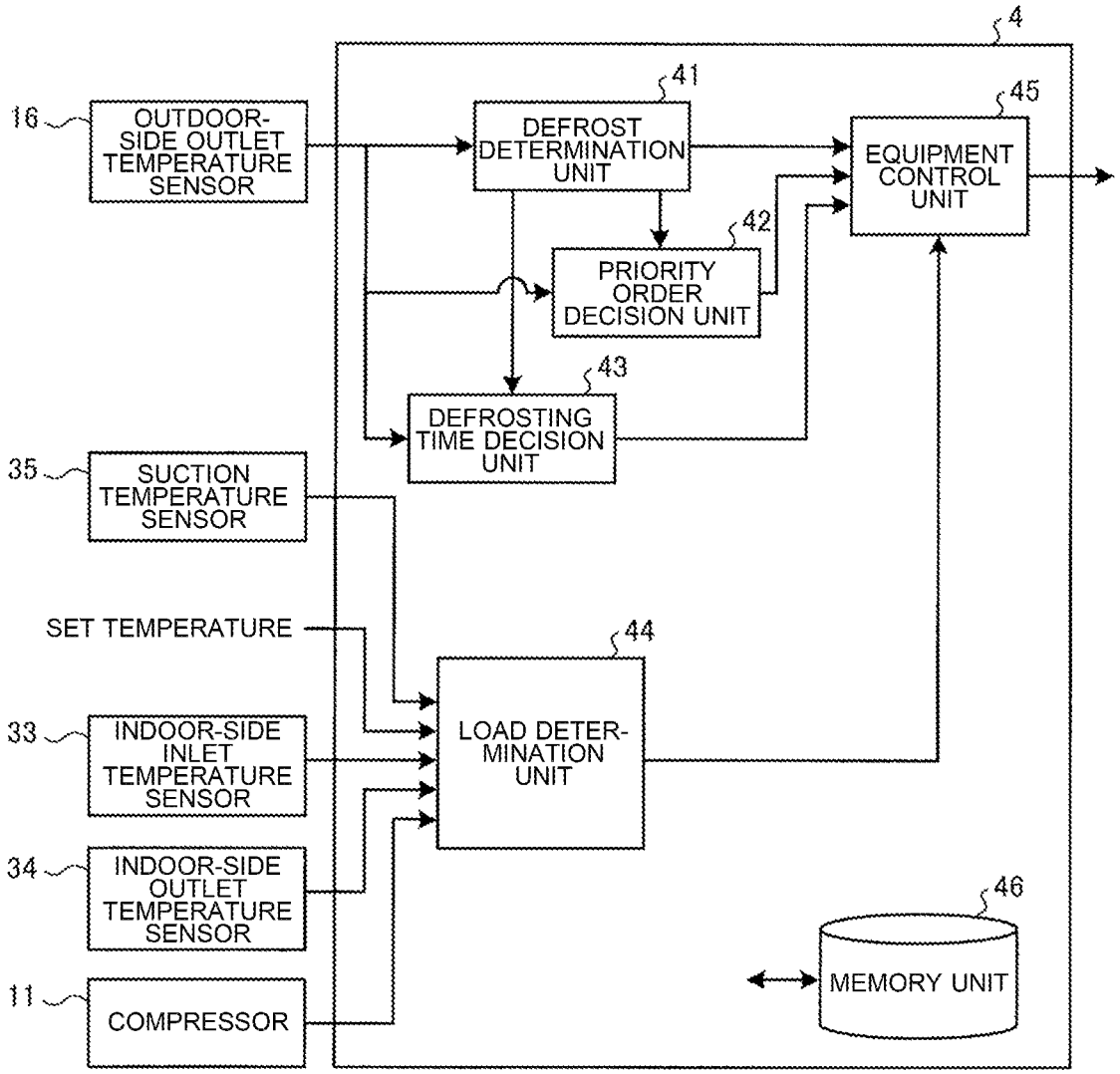
FIG. 4 is a function block diagram showing an example of the configuration of a controller shown in FIG. 1.

FIG. 4 is a function block diagram showing an example of the configuration of the controller 4 shown in FIG. 1. As shown in FIG. 4, the controller 4 includes a defrost determination unit 41, a priority order determination unit 42, a defrosting time determination unit 43, a load determination unit 44, an equipment control unit 45, and a memory unit 46.

The defrost determination unit 41 determines the necessity for a defrosting operation based on the refrigerant outlet temperature of the outdoor heat exchanger 13 in each of the outdoor units 1A to 1C, and based on a set temperature set in advance and stored in the memory unit 46. The set temperature is a threshold set for the refrigerant outlet temperature to determine the necessity for the defrosting operation. The defrost determination unit 41 determines the necessity for the defrosting operation for each of the outdoor units 1A to 1C.

In the case where the defrosting operation is necessary for all of the outdoor units 1A to 1C, the priority order determination unit 42 determines the order of priority of the defrosting operations for all of the outdoor units 1A to 1C, based on the determination result from the defrost determination unit 41. The order of priority is determined for performing the defrosting operations on the outdoor units in order of decreasing necessity for the defrosting operation.

The defrosting time determination unit 43 determines a defrosting time, meaning the time for the defrosting operation, for an outdoor unit on which the defrosting operation is to be performed. The defrosting time determination unit 43 determines the defrosting time based on the refrigerant outlet temperature in the outdoor unit on which the defrosting operation is to be performed and a defrosting time determination table stored in advance in the memory unit 46. The defrosting time determination table is a table where refrigerant outlet temperatures and defrosting times are associated with each other, and a defrosting time is associated in a stepwise manner with every set range of a refrigerant outlet temperature.

The load determination unit 44 compares an indoor unit total load, being the sum of air conditioning loads on the indoor units 3A to 3C during the heating operation, with an outdoor unit total capacity, being the sum of the capacities of outdoor units other than the outdoor unit on which the defrosting operation is to be performed. With such a comparison, the load determination unit 44 determines the magnitude of the indoor unit total load relative to the outdoor unit total capacity. In the case where the indoor unit total load is greater than the outdoor unit total capacity, the load determination unit 44 further determines the magnitude of the indoor unit total load using a water temperature threshold Tv stored in advance in the memory unit 46. The water temperature threshold Tv is a threshold set in relation to the temperature of water in the relay device corresponding to the outdoor unit on which the defrosting operation is to be performed. For example, the water temperature threshold Tv is a set temperature for the indoor unit 3A to 3C, or a temperature specified based on the set temperature, such as "2 degrees C. below the set temperature".

The equipment control unit 45 controls the outdoor units 1A to 1C, the relay devices 2A to 2C, and the indoor units 3A to 3C based on the processing results from the units of the controller 4. Particularly, In Embodiment 1, the equipment control unit 45 controls the outdoor units 1A to 1C and the relay devices 2A to 2C when the defrosting operation is performed. The equipment control unit 45 also controls the outdoor units 1A to 1C, the relay devices 2A to 2C, and the indoor units 3A to 3C according to the determination result from the load determination unit 44.

The memory unit 46 stores in advance the set temperature used by the defrost determination unit 41, the defrosting time determination table used by the defrosting time determination unit 43, and the water temperature threshold Tv used by the load determination unit 44.

Figure 5:
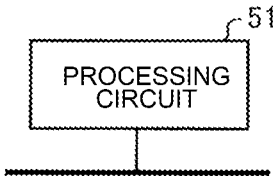
FIG. 5 is a hardware configuration diagram showing an example of the configuration of the controller shown in FIG. 4.

FIG. 5 is a hardware configuration diagram showing an example of the configuration of the controller 4 shown in FIG. 4. In the case where the various functions of the controller 4 are executed by hardware, as shown in FIG. 5, the controller 4 shown in FIG. 4 is a processing circuit 51. Each of functions of the defrost determination unit 41, the priority order determination unit 42, the defrosting time determination unit 43, the load determination unit 44, the equipment control unit 45, and the memory unit 46 shown in FIG. 4 is implemented by the processing circuit 51.

In the case where each of the functions is executed by hardware, for example, the processing circuit 51 corresponds to a single circuit, a composite circuit, a programmed processor, a parallel programmed processor, an application specific integrated circuit (ASIC), a field-programmable gate array (FPGA), or the combination of these. Each of the functions of the defrost determination unit 41, the priority order determination unit 42, the defrosting time determination unit 43, the load determination unit 44, the equipment control unit 45, and the memory unit 46 may be implemented by the processing circuit 51, or the functions of the units may be implemented by one processing circuit 51.

Figure 6:
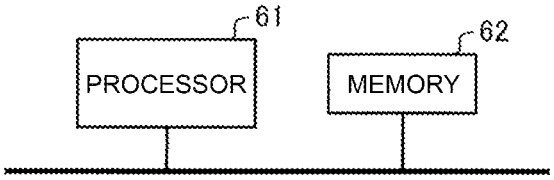
FIG. 6 is a hardware configuration diagram showing another example of the configuration of the controller shown in FIG. 4.

FIG. 6 is a hardware configuration diagram showing another example of the configuration of the controller 4 shown in FIG. 4. In the case where the various functions of the controller 4 are executed by software, as shown in FIG. 6, the controller 4 shown in FIG. 4 includes a processor 61 and a memory 62. The functions of the defrost determination unit 41, the priority order determination unit 42, the defrosting time determination unit 43, the load determination unit 44, the equipment control unit 45, and the memory unit 46 shown in FIG. 4 are implemented by the processor 61 and the memory 62.

In the case where each of the functions is executed by software, the functions of the defrost determination unit 41, the priority order determination unit 42, the defrosting time determination unit 43, the load determination unit 44, and the equipment control unit 45 are implemented by software, firmware, or the combination of the software and the firmware. The software or the firmware is described as a program, and is stored in the memory 62. The processor 61 reads and executes the program stored in the memory 62 to implement the functions of the respective units.

As the memory 62, for example, a nonvolatile or volatile semiconductor memory may be used, such as a random access memory (RAM), a read only memory (ROM), a flash memory, an erasable and programmable ROM (EPROM), or an electrically erasable and programmable ROM (EEPROM). Further, as the memory 62, for example, a detachable recording medium may be used, such as a magnetic disk, a flexible disk, an optical disc, a compact disc (CD), a mini disc (MD) or a digital versatile disc (DVD).

[Defrost Control]

The defrost control performed by the air-conditioning apparatus 100 according to Embodiment 1 will be described. In this defrost control, the operations of the outdoor units 1A to 1C are controlled to prevent all of the outdoor units 1A to 1C from performing the defrosting operation simultaneously during the heating operation. At the same time, the defrost control allows the heating operation to be continuously performed.

Figure 7:
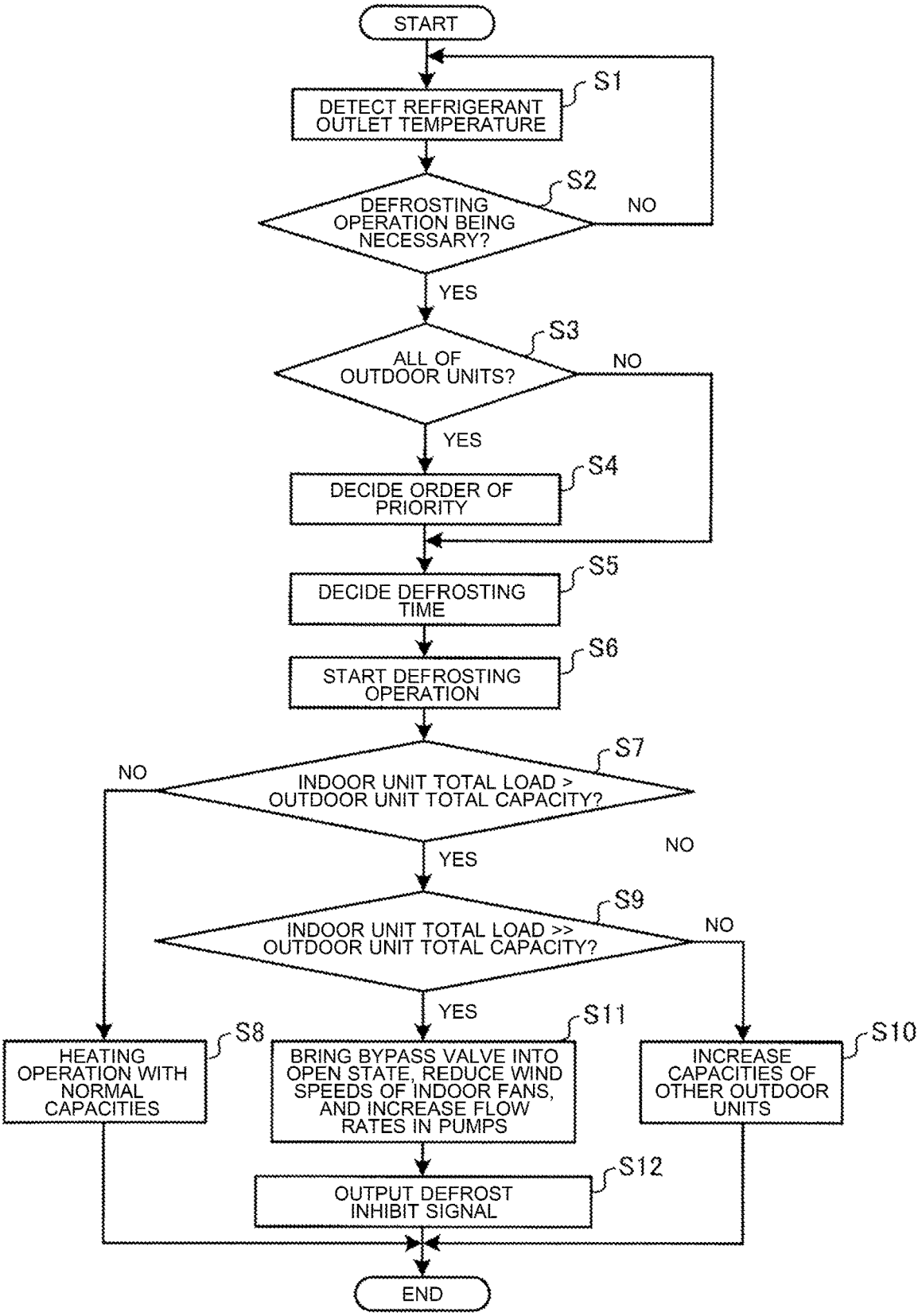
FIG. 7 is a flowchart showing an example of the flow of a processing of defrost control according to Embodiment 1.

FIG. 7 is a flowchart showing an example of the flow of a processing of defrost control according to Embodiment 1. This defrost control is performed when the defrosting operation becomes necessary during the heating operation. First, in step S1, the outdoor-side outlet temperature sensor 16 provided to each of the outdoor units 1A to 1C detects the refrigerant outlet temperature of refrigerant flowing out from the outdoor heat exchanger 13 during the heating operation.

In step S2, the controller 4 determines whether or not the defrosting operation is necessary for each of the outdoor units 1A to 1C. In this case, the controller 4 determines the necessity for the defrosting operation based on the refrigerant outlet temperature of the outdoor heat exchanger 13 of each of the outdoor units 1A to 1C and the set temperature for determining the necessity for the defrosting operation.

The defrost determination unit 41 reads the set temperature from the memory unit 46, and compares the refrigerant outlet temperature detected by the outdoor-side outlet temperature sensor 16 with the set temperature. When the refrigerant outlet temperature is equal to or below the set temperature, the defrost determination unit 41 determines that the defrosting operation is necessary (step S2; Yes), so that the processing advances to step S3. In contrast, when the refrigerant outlet temperature is above the set temperature, the defrost determination unit 41 determines that the defrosting operation is not necessary (step S2; No), so that the processing returns to step S1.

In step S3, the defrost determination unit 41 determines whether or not the defrosting operation is necessary for all of the outdoor units 1A to 1C. When the refrigerant outlet temperatures in all of the outdoor units 1A to 1C are equal to or below the set temperature, so that it is determined that the defrosting operation is necessary for all of the outdoor units 1A to 1C (step S3; Yes), the processing advances to step S4. In contrast, when the refrigerant outlet temperature in any one of the outdoor units 1A to 1C is above the set temperature, so that it is determined that the defrosting operation is not necessary for all of the outdoor units 1A to 1C (step S3; No), the processing advances to step S5.

In step S4, the priority order determination unit 42 determines the order of priority of the defrosting operations for all of the outdoor units 1A to 1C where the defrosting operation is necessary. In Embodiment 1, the order of priority for the outdoor units 1A to 1C is set such that the defrosting operation is preferentially performed on an outdoor unit with a high possibility of frost formed on the outdoor heat exchanger 13, or on an outdoor unit with a larger amount of frost already formed on the outdoor heat exchanger 13.

The outdoor unit with a high possibility of frost formed on the outdoor heat exchanger 13 or the outdoor unit with a large amount of formed frost has a lower refrigerant outlet temperature than an outdoor unit having a low possibility of frost or an outdoor unit with a small amount of formed frost. Therefore, based on the refrigerant outlet temperatures in the outdoor units 1A to 1C, the priority order determination unit 42 determines the order of priority of the defrosting operations for the outdoor units 1A to 1C such that an outdoor unit with a lower refrigerant outlet temperature has a higher order of priority.

In step S5, the defrosting time determination unit 43 determines a defrosting time for an outdoor unit that is the target of the defrosting operation (hereinafter, referred to as "target outdoor unit" when appropriate). A time required for defrosting the outdoor heat exchanger 13 increases as the amount of formed frost increases. Therefore, it is preferable to increase the defrosting time as the amount of formed frost increases. However, as described above, the outdoor unit with a larger amount of frost formed on the outdoor heat exchanger 13 has a lower refrigerant outlet temperature. Therefore, the defrosting time determination unit 43 sets a defrosting time such that an outdoor unit with a lower refrigerant outlet temperature has a longer defrosting time. Hereinafter, to facilitate the understanding of the defrost control, the description will be made with reference to the example of the case where the outdoor unit 1B acts as an outdoor unit that is the target of the defrosting operation, and outdoor units 1A and 1C excluding the outdoor unit 1B act as outdoor units that are not the target of the defrosting operation.

Defrosting times are set in a stepwise manner according to the refrigerant outlet temperatures. In Embodiment 1, a defrosting time determination table is prepared where the defrosting time is associated in a stepwise manner with every set range of the refrigerant outlet temperature. The defrosting time determination table is stored in advance in the memory unit 46. The defrosting time determination unit 43 determines a defrosting time by referencing to the set temperature stored in the memory unit 46 based on the refrigerant outlet temperature in the outdoor unit 1B on which the defrosting operation is to be performed.

In step S6, the equipment control unit 45 controls the outdoor units 1A to 1C and the relay devices 2A to 2C to start the defrosting operation for the outdoor unit 1B that is the target of the defrosting operation. The defrosting operation is performed only for the defrosting time determined in step S5. In the case where the order of priority for the outdoor units 1A to 1C is determined in step S4, the equipment control unit 45 starts the defrosting operation for the outdoor units 1A to 1C in order according to the determined order of priority and the defrosting time set in step S5.

Next, in step S7, the load determination unit 44 compares an indoor unit total load, being the sum of loads on the indoor units 3A to 3C during the heating operation, with an outdoor unit total capacity, being the sum of the capacities of the outdoor units excluding the target outdoor unit 1B (hereinafter, referred to as "the other outdoor units" when appropriate) 1A and 1C. The load determination unit 44 determines whether or not the indoor unit total load is greater than the outdoor unit total capacity.

The indoor unit total load can be obtained based on the difference between a suction air temperature detected by the suction temperature sensor 35 and the set temperature for the indoor space. The set temperature is a target temperature of the indoor space set by using a remote control or other device not shown in the drawing. The indoor unit total load is not limited to the above, and may be obtained based on the difference between a heat medium inlet temperature detected by the indoor-side inlet temperature sensor 33 and a heat medium outlet temperature detected by the indoor-side outlet temperature sensor 34. The outdoor unit total capacity is a capacity that the outdoor units 1A to 1C can exhibit during the operation, and can be obtained based on the operating frequencies of the compressors 11.

When the indoor unit total load is equal to or lower than the outdoor unit total capacity in step S7 (step S7; No), the other outdoor units 1A and 1C can handle loads on the indoor units 3A to 3C during the heating operation with normal capacities. Therefore, in step S8, the equipment control unit 45 controls units of the other outdoor units 1A and 1C such that the other outdoor units 1A and 1C continue the heating operation with capacities substantially equal to the normal capacities.

In contrast, when the indoor unit total load is higher than the outdoor unit total capacity (step S7; Yes), the processing advances to step S9. In step S9, the load determination unit 44 determines whether or not the indoor unit total load is excessively greater than the outdoor unit total capacity. In this case, the load determination unit 44 reads the water temperature threshold Tv from the memory unit 46, and compares the temperature of water in the relay device 2B corresponding to the target outdoor unit 1B with the read water temperature threshold Tv. When the water temperature in the relay device 2B is equal to or higher than the water temperature threshold Tv as a result of the comparison, the load determination unit 44 determines that the indoor unit total load is not significantly larger than the outdoor unit total capacity (step S9; No).

In this case, the target outdoor unit 1B is in the defrosting operation, so that the heat medium heat exchanger 21 of the relay device 2B corresponding to the target outdoor unit 1B serves as an evaporator. In other words, water flowing into the heat medium heat exchanger 21 of the relay device 2B exchanges heat with refrigerant, thus being cooled, and then flows out from the heat medium heat exchanger 21 with a temperature lower than the temperature at which the water flows into the heat medium heat exchanger 21. Therefore, for water obtained by the merge of water flowing out from the heat medium heat exchangers 21 of the relay devices 2A and 2C corresponding to the other outdoor units 1A and 1C and water flowing out from the heat medium heat exchanger 21 of the relay device 2B, the temperature of the water obtained by the merge when the defrosting operation is performed is lower than the temperature of the water obtained by the merge when the defrosting operation is not performed. When such water having a decreased temperature flows into the indoor units 3A to 3C, the temperature of indoor air decreases during the heating operation, so that comfort may be impaired.

In view of the above, in such a case, the decrease in the temperature of water flowing out from the relay device 2B is compensated for by increasing the temperature of water flowing out from the relay devices 2A and 2C. Specifically, in step S10, the equipment control unit 45 performs control such that the operating frequencies of the compressors 11 of the other outdoor units 1A and 1C that are not in the defrosting operation are increased to increase the capacities of the other outdoor units 1A and 1C. With such control, the temperature of water flowing out from the relay devices 2A and 2C rises and hence, it is possible to compensate for the decrease in the temperature of water flowing out from the relay device 2B, so that the merged water is allowed to have a temperature substantially equal to a temperature of water when the defrosting operation is not performed. Therefore, a decrease in the temperature of indoor air can be suppressed, and a heating operation substantially equal to the normal heating operation can be continued.

In contrast, when a water temperature in the relay device 2B is lower than the water temperature threshold Tv in step S9, the load determination unit 44 determines that the indoor unit total load is extremely greater than the outdoor unit total capacity (step S9; Yes). Also in this case, the target outdoor unit 1B is in the defrosting operation, and the heat medium heat exchanger 21 of the relay device 2B serves as an evaporator. Further, a water temperature in the relay device 2B is below the set temperature for the indoor units 3A to 3C. If the heating operation is performed in this state, it is difficult to allow indoor air to have the set temperature. Accordingly, it is necessary to perform operations to cause the water temperature to be above the set temperature.

In view of the above, when the indoor unit total load is extremely greater than the outdoor unit total capacity, the controller 4 stops the heating operation, and controls the units of the relay devices 2A to 2C and the units of the indoor units 3A to 3C such that the water temperature is above the set temperature.

Specifically, in step S11, the equipment control unit 45 brings the bypass valve 23 of the relay device 2B corresponding to the target outdoor unit 1B into an open state. With such an operation, refrigerant flowing out from the outdoor unit 1B flows through the bypass 20 without flowing into the heat medium heat exchanger 21 of the relay device 2B, and then flows into the outdoor unit 1B again. Further, with such a flow of refrigerant, heat exchange between refrigerant and water is not performed in the heat medium heat exchanger 21 serving as an evaporator. Accordingly, it is possible to suppress a decrease in the temperature of water flowing out from the relay device 2B.

The equipment control unit 45 also reduces the wind speeds of the indoor fans 32 of all of the indoor units 3A to 3C. With such a reduction, it is possible to reduce the amount of heat exchange performed by the indoor heat exchanger 31 between indoor air and water with a low temperature and hence, a decrease in the temperature of indoor air can be suppressed. In this case, the equipment control unit 45 may perform control to stop the indoor fans 32.

In addition to the above, the equipment control unit 45 increases flow rates in the pumps 22 of all of the relay devices 2A to 2C. Such an increase promotes a rise in the temperature of water brought about by the other outdoor units 1A and 1C and hence, the temperature of water is allowed to rapidly rise.

In the case where the temperature of water flowing out from the relay devices 2A to 2C is below the set temperature, the starting of the heating operation is delayed. However, controlling the actions of the units as described above allows the heating operation to be rapidly restarted.

Next, in step S12, the equipment control unit 45 outputs a defrost inhibit signal for inhibiting the defrosting operation to the other outdoor units 1A and 1C. With such an operation, it is possible to prevent the plurality of outdoor units from performing the defrosting operation simultaneously.

As described above, in the air-conditioning apparatus 100 according to Embodiment 1, when the indoor unit total load during the heating operation is greater than the outdoor unit total capacity, the outdoor unit total capacities of the outdoor units 1A and 1C, excluding the outdoor unit that is the target of the defrosting operation, are increased. With such an increase, the outdoor unit total capacity reduced due to the defrosting operation is compensated for and hence, an outdoor unit total capacity required during the heating operation can be ensured. Accordingly, it is possible to continue the heating operation without stopping the operation of the indoor units 3A to 3C even during the defrosting operation.

In the air-conditioning apparatus 100, the defrost determination unit 41 determines that the defrosting operation is necessary when the refrigerant outlet temperature is equal to or below the set temperature. With such a determination, it is possible to easily determine the necessity for the defrosting operation for the outdoor units 1A to 1C.

In the air-conditioning apparatus 100, the load determination unit 44 obtains an indoor unit total load based on a suction temperature and a set temperature, and obtains an outdoor unit total capacity based on the operating frequencies of the compressors 11 of the other outdoor units 1A and 1C. With such operations, in the air-conditioning apparatus 100, control is performed during the heating operation according to the indoor unit total load and the outdoor unit total capacity and hence, it is possible to continue the heating operation in a state where the defrosting operation is being performed for the outdoor unit 1B. In the air-conditioning apparatus 100, the load determination unit 44 may obtain the indoor unit total load based on a heat medium inlet temperature and a heat medium outlet temperature. Also with such an operation, it is possible to continue the heating operation in a state where the defrosting operation is being performed for the outdoor unit 1B.

In the air-conditioning apparatus 100, when the temperature of the heat medium flowing through the relay device 2B connected to the target outdoor unit 1B is lower than the water temperature threshold Tv, the equipment control unit 45 brings the bypass valve 23 of the relay device 2B connected to the target outdoor unit 1B into an open state, reduces the wind speeds of the indoor fans 32 of all of the indoor units 3A to 3C or stops the indoor fans 32, and increases the flow rates in the pumps 22 of all of the relay devices 2A to 2C. With such operations, the temperature of water being a heat medium is allowed to rapidly rise while a decrease in the temperature of the indoor space is suppressed and hence, the heating operation can be restarted at an early stage.

In the air-conditioning apparatus 100, when the defrost determination unit 41 determines that the defrosting operation is necessary for all of the outdoor units 1A to 1C, the priority order determination unit 42 determines the order of priority in the case of performing the defrosting operation for all of the outdoor units 1A to 1C. At this point of operation, the priority order determination unit 42 determines the order of priority such that an outdoor unit with a lower refrigerant outlet temperature has a higher order of priority. With such a determination, it is possible to prevent all of the outdoor units 1A to 1C from performing the defrosting operation simultaneously and hence, it is possible to continue the heating operation even in a state where the defrosting operation is being performed.

In the air-conditioning apparatus 100, the defrosting time determination unit 43 determines defrosting times in the case of performing the defrosting operation for all of the outdoor units 1A to 1C. At this point of operation, the defrosting time determination unit 43 determines the defrosting times such that an outdoor unit with a lower refrigerant outlet temperature has a longer defrosting time. With such a determination, it is possible to surely defrost the outdoor heat exchanger 13 on which frost is formed. Also in the case where frost is not formed on the outdoor heat exchanger 13, it is possible to surely prevent frost from forming on the outdoor heat exchanger 13.

In the air-conditioning apparatus 100, the defrosting time determination unit 43 determines defrosting times, using the defrosting time determination table where the defrosting time is associated in a stepwise manner with every set range of the refrigerant outlet temperature, such that an outdoor unit with a lower refrigerant outlet temperature has a longer defrosting time increased in a stepwise manner. With such a determination, it is possible to surely defrost the outdoor heat exchanger 13 on which frost is formed. Also in the case where frost is not formed on the outdoor heat exchanger 13, it is possible to surely prevent frost from forming on the outdoor heat exchanger 13. Further, the defrosting time is associated in a stepwise manner with every set range of the refrigerant outlet temperature and hence, it is possible to easily set a defrosting time according to the amount of formed frost or a possibility of frost.

Embodiment 1 of the present disclosure has been described heretofore. However, the present disclosure is not limited to the above-mentioned Embodiment 1 of the present disclosure, and various modifications and applications are conceivable without departing from the gist of the present disclosure. The necessity for the defrosting operation is determined by comparing the refrigerant outlet temperature of the outdoor heat exchanger 13 with the set temperature. However, the method of determining the necessity for the defrosting operation is not limited to the above. For example, the necessity for the defrosting operation may be determined by comparing an evaporating temperature with a specified temperature.

REFERENCE SIGNS LIST

1A, 1B, 1C outdoor unit 2A, 2B, 2C relay device 3A, 3B, 3C indoor unit 4 controller 5A, 5B, 5C flow control valve 6A, 6B, 6C pressure sensor 7A, 7B, 7C pressure sensor 11 compressor 12 refrigerant flow passage switching device 13 outdoor heat exchanger 14 outdoor fan 15 expansion device 16 outdoor-side outlet temperature sensor 20 bypass 21 heat medium heat exchanger 22 pump 23 bypass valve 31 indoor heat exchanger 32 indoor fan 33 indoor-side inlet temperature sensor 34 indoor-side outlet temperature sensor 35 suction temperature sensor 41 defrost determination unit 42 priority order determination unit 43 defrosting time determination unit 44 load determination unit 45 equipment control unit 46 memory unit 51 processing circuit 61 processor 62 memory 100 air-conditioning apparatus.

The invention claimed is:

1. An air-conditioning apparatus comprising:

a plurality of outdoor units through which refrigerant flows, the plurality of outdoor units each including a compressor and an outdoor heat exchanger;

at least one indoor unit through which a heat medium flows, the at least one indoor unit including an indoor heat exchanger;

a plurality of relay devices to which the plurality of outdoor units are connected independently, and to which the indoor unit is connected, each of the plurality of relay devices including a heat medium heat exchanger configured to exchange heat between the refrigerant and the heat medium; and a controller configured to control action of the plurality of outdoor units, the indoor unit, and the plurality of relay devices, the controller being configured to determine the necessity for a defrosting operation for each of the plurality of outdoor units, responsive to determining that the defrosting operation is necessary, compare an indoor unit total load with an outdoor unit total capacity, the indoor unit total load indicating an air conditioning load during a heating operation, the outdoor unit total capacity indicating a capacity of an other outdoor unit excluding a target outdoor unit where the defrosting operation is necessary, and responsive to determining that the indoor unit total load is greater than the outdoor unit total capacity as a result of comparing, control an operating frequency of the compressor of the other outdoor unit to increase the outdoor unit total capacity.

2. The air-conditioning apparatus of claim 1, wherein each of the plurality of outdoor units further includes an outdoor-side outlet temperature sensor configured to detect a refrigerant outlet temperature of the refrigerant flowing out from the outdoor heat exchanger during the heating operation, and the controller determines that the defrosting operation is necessary in a case where the refrigerant outlet temperature is equal to or below a set temperature set in advance for the refrigerant outlet temperature.

3. The air-conditioning apparatus of claim 1, wherein the indoor unit further includes a suction temperature sensor configured to detect a suction temperature being a temperature of air in an indoor space, the air being to be supplied to the indoor heat exchanger, the controller obtains the indoor unit total load based on the suction temperature and a set temperature indicating a target temperature of the indoor space, and the controller obtains the outdoor unit total capacity based on the operating frequency of the compressor of the other outdoor unit.

4. The air-conditioning apparatus of claim 1, wherein the indoor unit further includes an indoor-side inlet temperature sensor configured to detect a heat medium inlet temperature of the heat medium flowing into the indoor heat exchanger, and an indoor-side outlet temperature sensor configured to detect a heat medium outlet temperature of the heat medium flowing out from the indoor heat exchanger, the controller obtains the indoor unit total load based on the heat medium inlet temperature and the heat medium outlet temperature, and the controller obtains the outdoor unit total capacity based on the operating frequency of the compressor of the other outdoor unit.

5. The air-conditioning apparatus of claim 1, wherein each of the plurality of relay devices further includes a bypass valve provided to a bypass that bypasses the heat medium flowing through the heat medium heat exchanger, and a pump configured to cause the heat medium to circulate, the indoor unit further includes an indoor fan configured to supply air to the indoor heat exchanger, and in a case where a temperature of the heat medium flowing through a relay device of the plurality of relay devices that is connected to the target outdoor unit is lower than a water temperature threshold set in advance as a comparison result from the load determination unit, the controller brings the bypass valve of the relay device connected to the target outdoor unit into an open state, reduces a wind speed of the indoor fan of the indoor unit or stops the indoor fan, and increases a flow rate in the pump of each of the plurality of relay devices.

6. The air-conditioning apparatus of claim 2, wherein the controller is further configured to determine an order of priority in performing the defrosting operation for all of the plurality of outdoor units in a case where the defrosting operation is necessary for all of the plurality of outdoor units as a result of a determination.

7. The air-conditioning apparatus of claim 6, wherein the controller determines the order of priority such that an outdoor unit with a lower refrigerant outlet temperature has a higher order of priority.

8. The air-conditioning apparatus of claim 6, wherein the controller is further configured to determine a defrosting time for each of the plurality of outdoor units in performing the defrosting operation for all of the plurality of outdoor units.

9. The air-conditioning apparatus of claim 8, wherein the controller determines the defrosting time such that an outdoor unit with a lower refrigerant outlet temperature has a longer defrosting time.

10. The air-conditioning apparatus of claim 8, wherein the controller determines the defrosting time, using a defrosting time determination table where the defrosting time is associated in a stepwise manner with every set range of the refrigerant outlet temperature, such that an outdoor unit with a lower refrigerant outlet temperature has a longer defrosting time increased in a stepwise manner.

11. The air-conditioning apparatus of claim 1, wherein the plurality of outdoor units are connected in parallel.

* * * * *